US007614537B2

(12) United States Patent
Andersson et al.

(10) Patent No.: US 7,614,537 B2
(45) Date of Patent: Nov. 10, 2009

(54) STAPLER WITH A MOVABLE ANVIL DEVICE

(75) Inventors: Mats Andersson, Mullsjö (SE); Mattias Palmquist, Hestra (SE); Trygve Gustavson, Åsenhöga (SE); Per-Åke Högberg, Åsenhöga (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 11/596,541

(22) PCT Filed: May 6, 2005

(86) PCT No.: PCT/SE2005/000658

§ 371 (c)(1),
(2), (4) Date: Nov. 22, 2006

(87) PCT Pub. No.: WO2005/115699

PCT Pub. Date: Dec. 8, 2005

(65) Prior Publication Data

US 2007/0125825 A1 Jun. 7, 2007

(30) Foreign Application Priority Data

May 25, 2004 (SE) ..... 0401340

(51) Int. Cl.
*B25C 5/02* (2006.01)

(52) U.S. Cl. ..... 227/120; 227/131; 227/132; 227/155; 227/156; 227/144; 227/134

(58) Field of Classification Search ..... 227/120, 227/131, 155, 156, 144, 134
See application file for complete search history.

(56) References Cited

U.S. PATENT DOCUMENTS 1,845,186 A 2/1932 Raeburn
2,149,839 A * 3/1939 Cavanagh ..... 227/124
2,354,760 A * 8/1944 Lindstrom ..... 227/121
2,786,201 A * 3/1957 Ehrlich ..... 227/124
4,040,556 A * 8/1977 Dahle ..... 227/120
4,051,991 A * 10/1977 Goodchild ..... 227/155
4,112,164 A * 9/1978 Koss ..... 428/116

(Continued)

FOREIGN PATENT DOCUMENTS

DE 196 50 240 A1 6/1998

(Continued)

*Primary Examiner*—Rinaldi I. Rada
*Assistant Examiner*—Michelle Lopez
(74) *Attorney, Agent, or Firm*—Miles & Stockbridge P.C.

(57) ABSTRACT

A stapler comprises a stapling unit and a base movably connected to each other. The base comprises an anvil, a lower and an upper part with a contact surface which has a staple opening against which a workpiece is placed. The upper and lower parts are movably connected to each other. In operation, movement of the stapling unit and the base toward each other drives a staple into the workpiece, wherein the staple crown comes in contact with the workpiece and the staple legs extend through the staple opening. Upon movement of the upper part and stapling unit toward the lower part, the staple legs are bent by the anvil into contact with the underside of the workpiece. The anvil is attached to the base by an elastic element between the lower and upper part, and is urged toward the staple opening to block the opening when the stapler is in an initial position.

20 Claims, 12 Drawing Sheets

U.S. PATENT DOCUMENTS

| | | | | |
|---|---|---|---|---|
| 4,778,096 | A | 10/1988 | Ebihara | |
| 5,782,397 | A * | 7/1998 | Koukline | 227/176.1 |
| 6,209,772 | B1 * | 4/2001 | Wang | 227/134 |
| 7,021,512 | B1 * | 4/2006 | Nakamura | 227/76 |
| 2006/0266787 | A1 * | 11/2006 | Ura | 227/131 |

FOREIGN PATENT DOCUMENTS

| | | | |
|---|---|---|---|
| GB | 206934 | A | 11/1923 |
| GB | 517352 | A | 1/1940 |
| WO | WO 03/057417 | A1 | 7/2003 |

* cited by examiner

STAPLER WITH A MOVABLE ANVIL DEVICE

TECHNICAL FIELD

The present invention relates to a stapler for stapling together a workpiece, primarily a sheaf of papers, which stapler comprises a stapling unit and a base part which, by means of a connecting means, are connected in such manner that they can be moved toward and away from each other in a reciprocating stapling movement, wherein the stapling unit contains staples and a driver, and the base part comprises a lower part and an upper part provided with a contact surface provided with a staple opening against which the workpiece to be stapled is placed during the stapling, wherein the upper part is connected to the lower part in such manner that it can be moved toward and away from the lower part during the stapling movement, wherein a latch arrangement is provided between the lower part and upper part to prevent the upper part from being moved toward the lower part, where an anvil device is arranged on the base part, wherein stapling is performed by moving the stapling unit and base part toward each other into contact with the workpiece, whereupon the driver drives a staple into the workpiece to a position in which the staple crown is in contact with the workpiece and the staple legs extend through the staple opening, whereupon a releasing device in the stapler releases the latch arrangement, whereupon the upper part and stapling unit are moved toward the lower part, whereby the staple legs are bent by the anvil device into contact against the underside of the workpiece.

STATE OF THE ART

Staplers of the type described above are already known. However, the disadvantage of these earlier known staplers is that when the anvil device is located under the upper part, a staple which is formed when the stapler executes an idle stroke without a workpiece in position, which can occur for various reasons, will remain in the base part of the stapler, which can interfere with the continued operation of the stapler in a number of different ways.

Problem

Thus, there exists a need for a stapler in which an idle stroke does not cause a staple used thereby to remain in the base part of the stapler.

Solution

The present invention overcomes the problems described by means of a stapler described above, which is characterised in that the anvil device is attached to the base part by means of an elastic element in the area between the lower part and upper part, and arranged so that it is moved toward the staple opening by the elastic element to block the opening when the stapler is in an initial position.

The present invention is also characterised in that the elastic element consists of a leaf spring, helical spring or similar spring element.

The present invention is further characterised in that during stapling, the staple legs displace the anvil device from the staple opening in the course of the stapling movement until the staple crown has been driven against the workpiece.

The present invention is yet further characterised in that the anvil device is in supporting contact with the lower part when the upper part is moved downward against the lower part.

BRIEF DESCRIPTION OF THE FIGURES

A preferred embodiment of the invention will hereinafter be described with reference to the appended figures, of which.

PREFERRED EMBODIMENT

Figure 1:
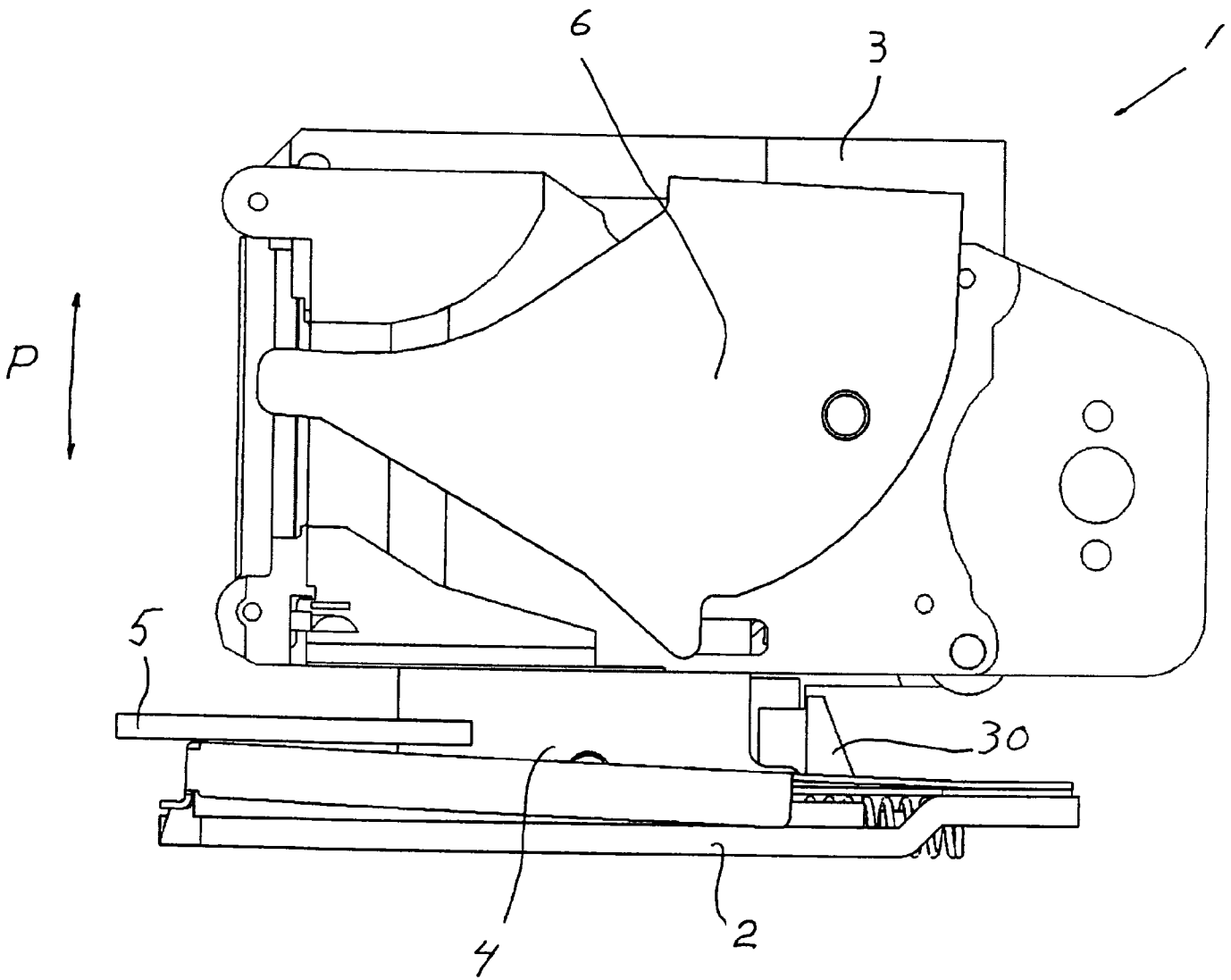
FIG. 1 is a schematic view of a stapler seen from the side in an initial position.
Figure 2:
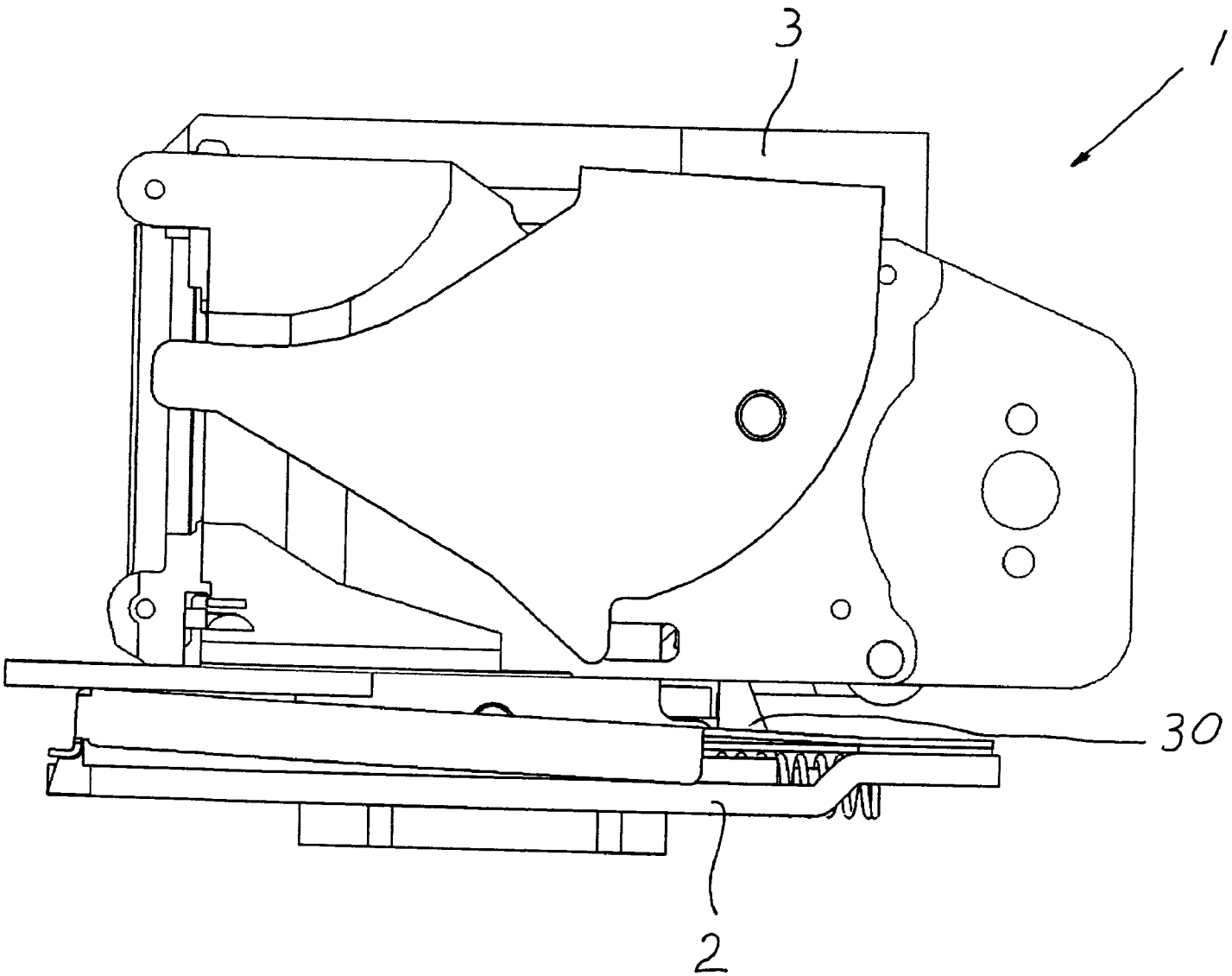
FIG. 2 is a view corresponding to FIG. 1 in which the stapler has executed parts of a stapling movement.
Figure 3:
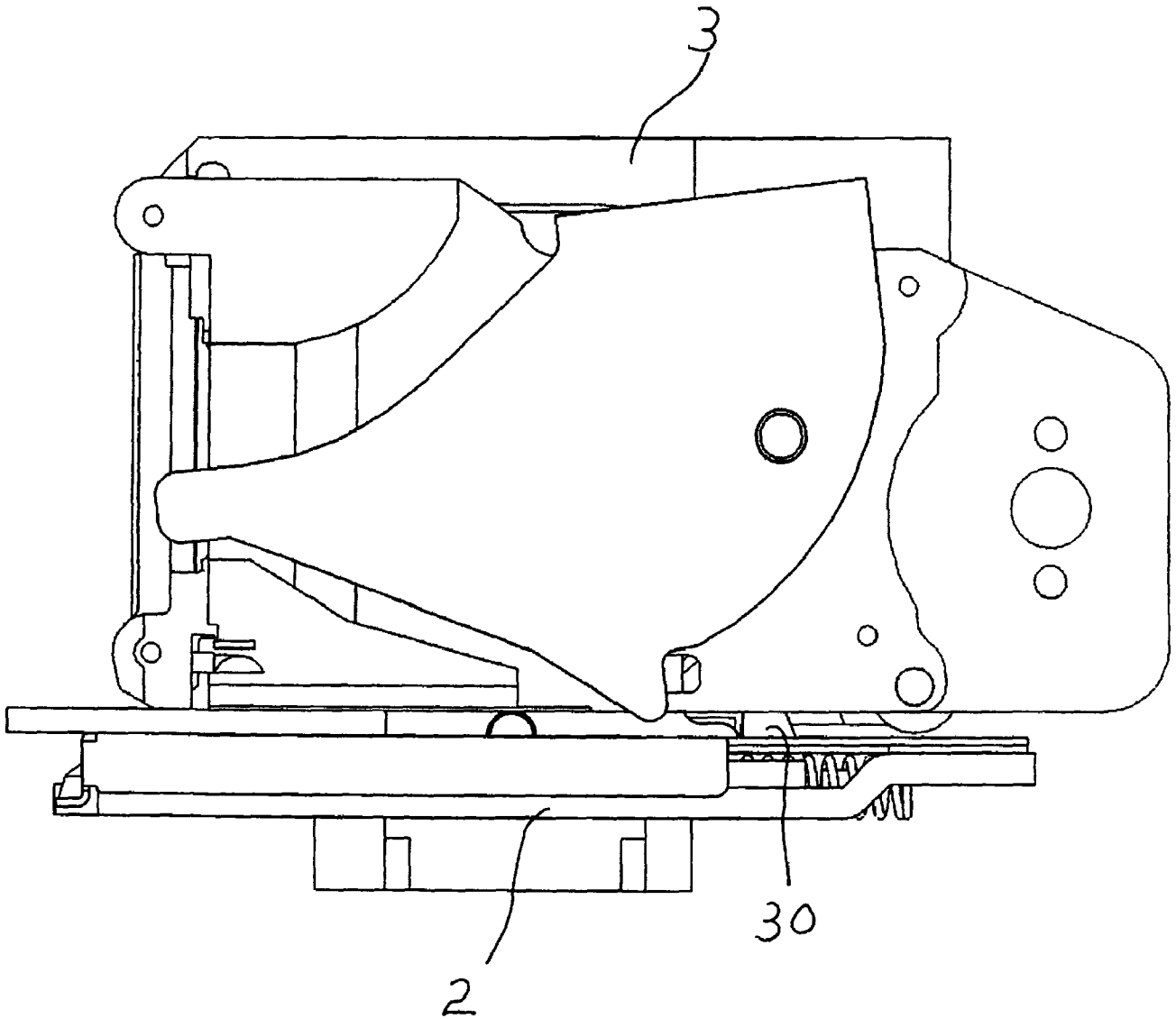
FIG. 3 is a view corresponding to FIGS. 1 and 2 in which the stapling movement has reached its lowermost position.

FIGS. 1-3 are schematic views of a stapler 1 according to the present invention comprising a base part 2 and a stapling unit 3 which, with the aid of a connecting means 4, are connected to each other in known manner such that they can be moved toward and away from each other in a reciprocating stapling movement as indicated by the double arrow P. The figures further show a workpiece 5, primarily a sheaf of papers, placed on the base part for stapling. The stapling unit is further provided with a drive arm 6 which is driven by a drive arrangement (not shown in the figures) included in the stapler and which drive arm is connected to a driver 7 included in the stapling unit, which driver is shown in FIGS. 5-8 and 10-12 and which, in known manner, is arranged to slide in the stapling unit so that it can be driven in a reciprocating manner during the stapling movement P, and whose function will be clear from description below. In FIG. 1, the stapler is shown in an initial position in which the workpiece 5 is placed on the base part 2 and in FIG. 2, the stapling unit 3 and base part 2 have, during the stapling movement, been moved by the drive arrangement (not shown) included in the stapling unit toward each other so as to contact the workpiece 5 from their respective sides. In FIG. 3, the stapler is shown in the lowermost position of the stapling movement, in which position a staple 8 has, in known manner, been stapled to the workpiece by driving of the drive arm 6 downward toward the base part, whereby the driver 7 included in the stapling unit has driven a staple housed in the stapling unit into the workpiece 5, which staple 8 is not shown in FIGS. 1-3 but is shown in FIGS. 5-8 and 10-12. On completion of stapling, the drive arrangement returns the stapling unit and base part to the position shown in FIG. 1 and the workpiece can be removed.

Figure 4:
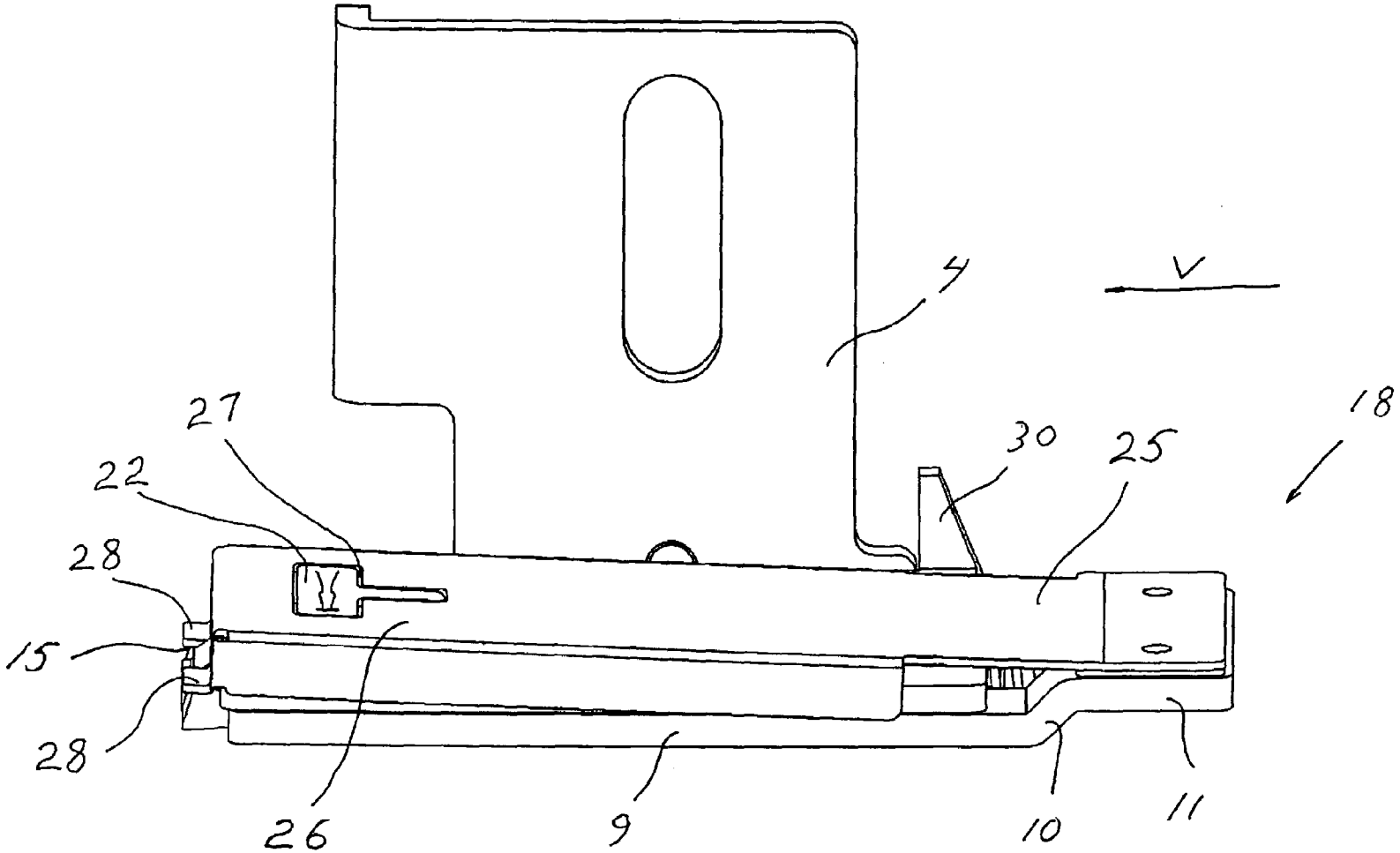
FIG. 4 shows a base part included in the invention.

The construction of the base part 2 will hereinafter be described in detail with reference to FIGS. 4 and 5. In FIG. 4, the base part is shown in a position corresponding to that shown in FIG. 1, but without a workpiece. The figures show that the base part comprises an elongated, plate-shaped lower part 9 which, at a rear end 10, is provided with a plateau 11. The lower part 9 carries a glidably mounted, elongated spacing means 12 which, at its front end 13, is provided with a projection 14 provided with support surfaces 15. A helical spring 17 is arranged in the area of the rear end 16 of the spacing means 12, which helical spring extends from the spacing means to the plateau on the lower part, and presses the spacing means in the direction indicated by the arrow V in FIG. 4. An elongated leaf spring 19 is connected to the plateau 11 by means of a connection arrangement 18, which is shown only schematically in the figure, which leaf spring extends to the front end of the lower part and is arranged so that, in the idle position, its front end 20 is slightly above its rear end 21. At the front end, the spring assumes the form of an anvil device 22 in which anvil slots 23 are provided. The leaf spring 19 is further provided with a step 24 whose function will be described below. The plate-shaped lower part 9 is further connected to an upper part 25 by means of the connection arrangement 18, which connection enables the upper part to be moved toward and away from the lower part as part of the stapling movement. The upper part 25 is provided with a contact surface 26 in which a staple opening 27 is disposed. Since the upper part is attached to the lower part in the manner shown in FIG. 4, the anvil device 22 blocks the staple opening 27, and by virtue of the step 24 and the somewhat higher position of the front end 20 relative to the rear end 21, the anvil device 22 is situated basically at the same level as the contact surface 26. The upper part is further provided at the front end with lugs 28 which is in contact with the support surfaces 15 in such manner that the upper part cannot be moved downward towards the lower part. The surfaces 15 and lugs 28 thus form a latch arrangement 15,28. The spacing means 12 is further provided with a recess 29 which is designed to enable the leaf spring and anvil device to be accommodated therein. Furthermore, the spacing means 12 is provided with a hook element 30 which, through contact with the connecting means 4, prevents the spacing means 12 from being moved further by the spring 17 in the direction indicated by the arrow V in FIG. 4.

Figure 8:
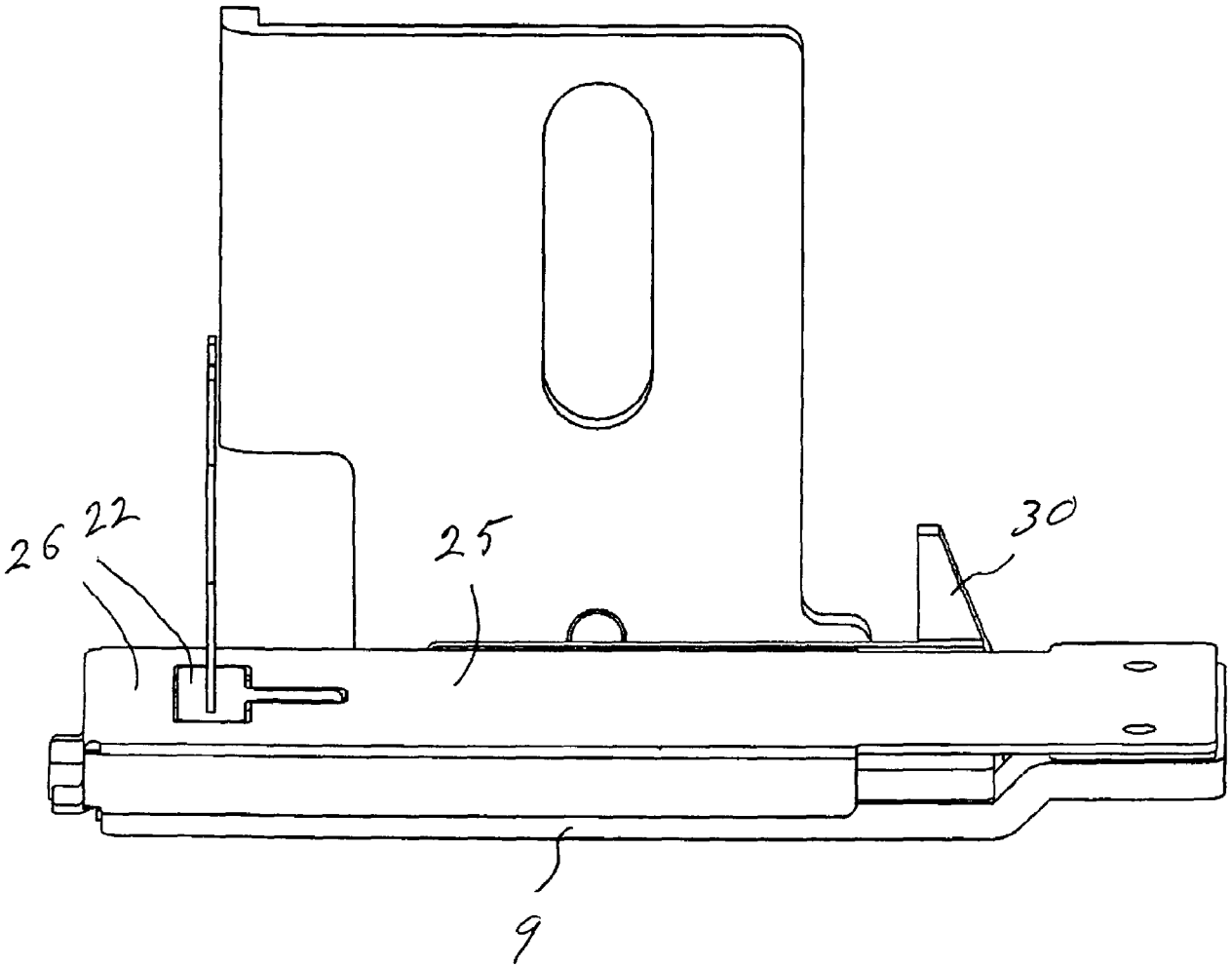
FIG. 8 is a view in which the base part is in the lowermost position of the stapling movement.

FIGS. 1-3 show that when the stapling unit and base part are brought together, the hook element 30 interacts with the stapling unit 3 and that as part of this interaction, the hook element is moved in the direction opposite to the direction V by an activating device in the stapling unit, which activating device is not shown clearly in the figures, whereby the support surfaces 15 are disengaged from contact with the lugs 28 and the upper part 25 is permitted to move downward toward the lower part 9 into the position shown in FIGS. 3 and 8.

Figure 5:
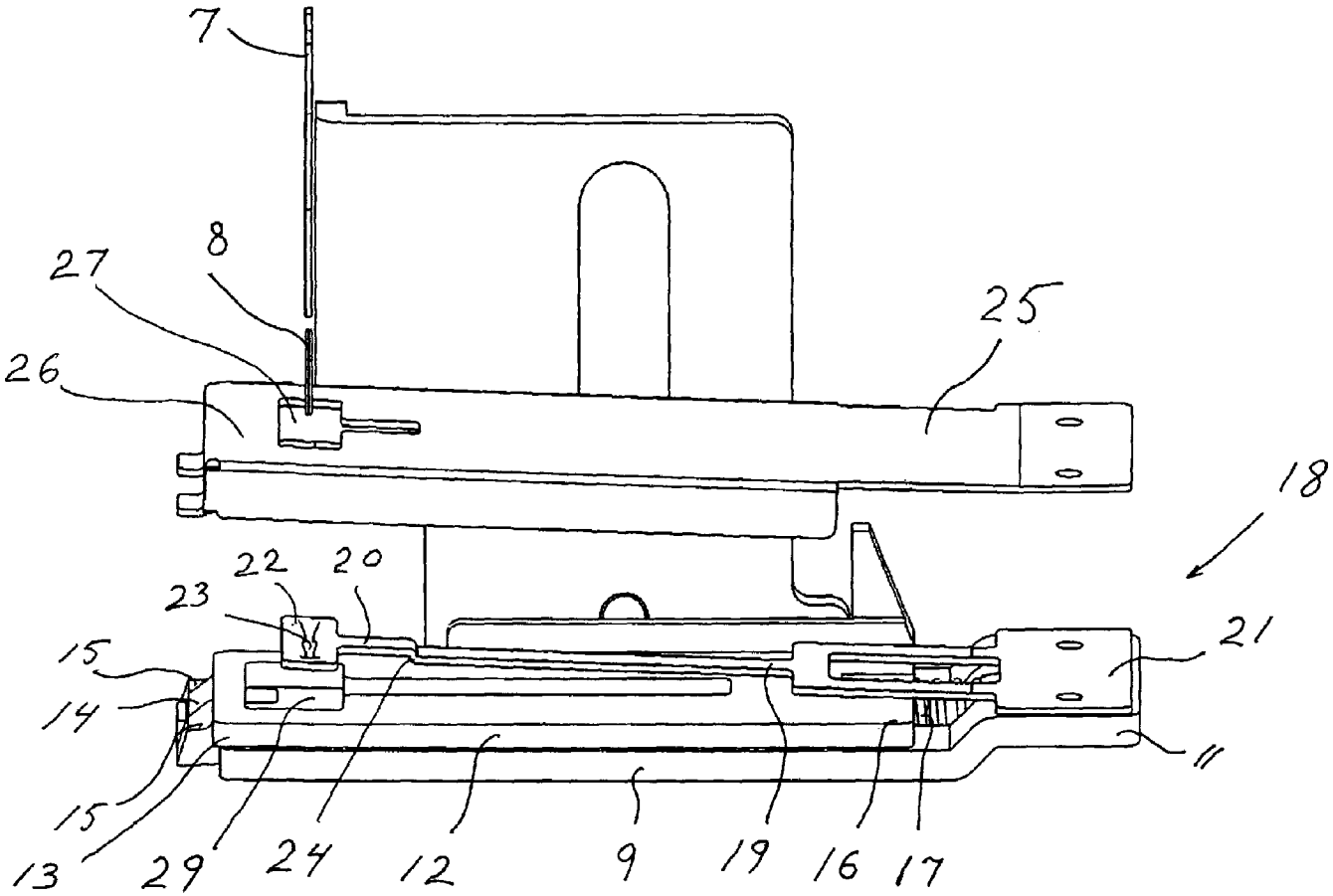
FIG. 5 is a partly exploded view of the base part shown in FIG. 4, and in which view a staple and driver are also shown.
Figure 6:
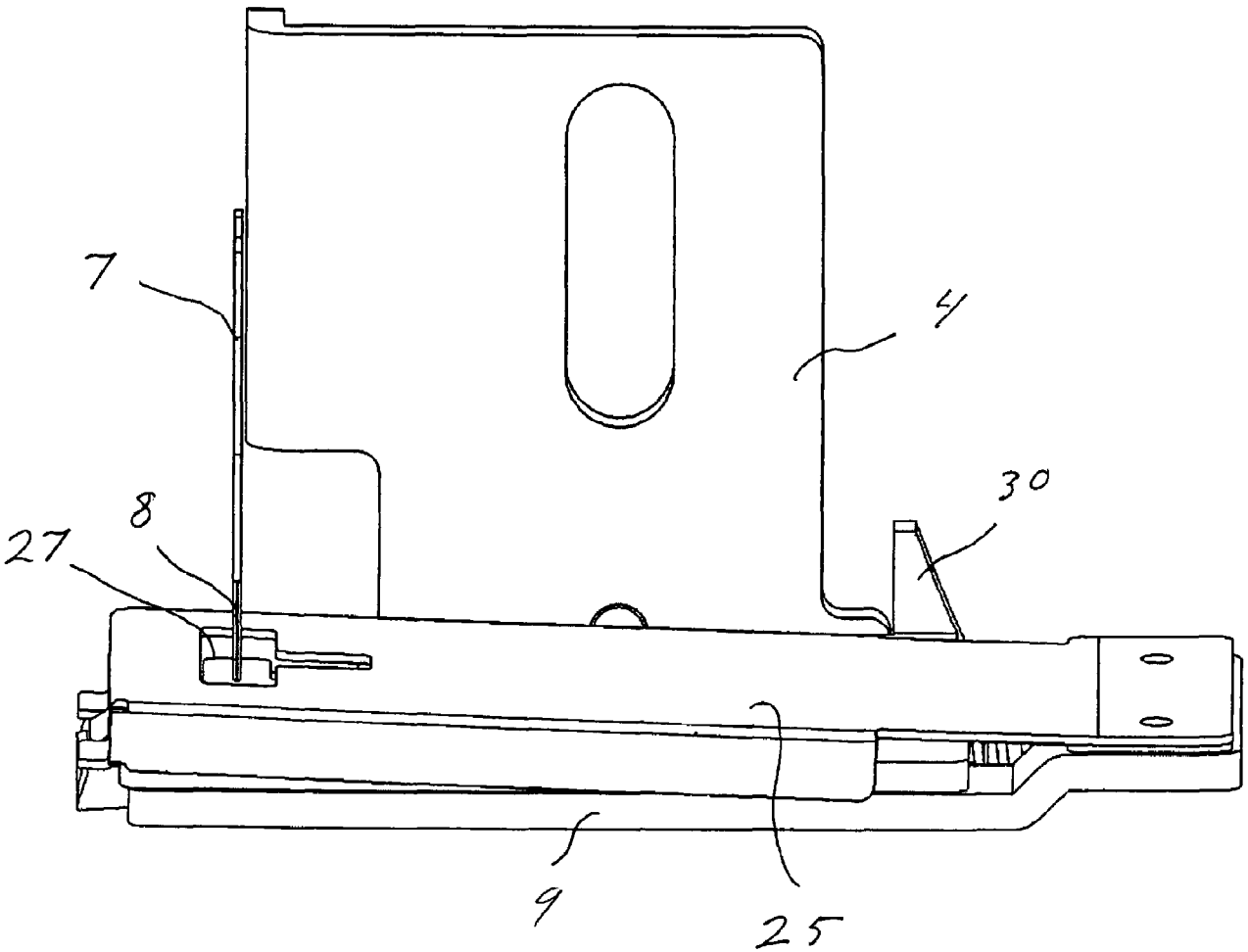
FIG. 6 is a view in which the base part is shown schematically after a first phase of a stapling movement.
Figure 7:
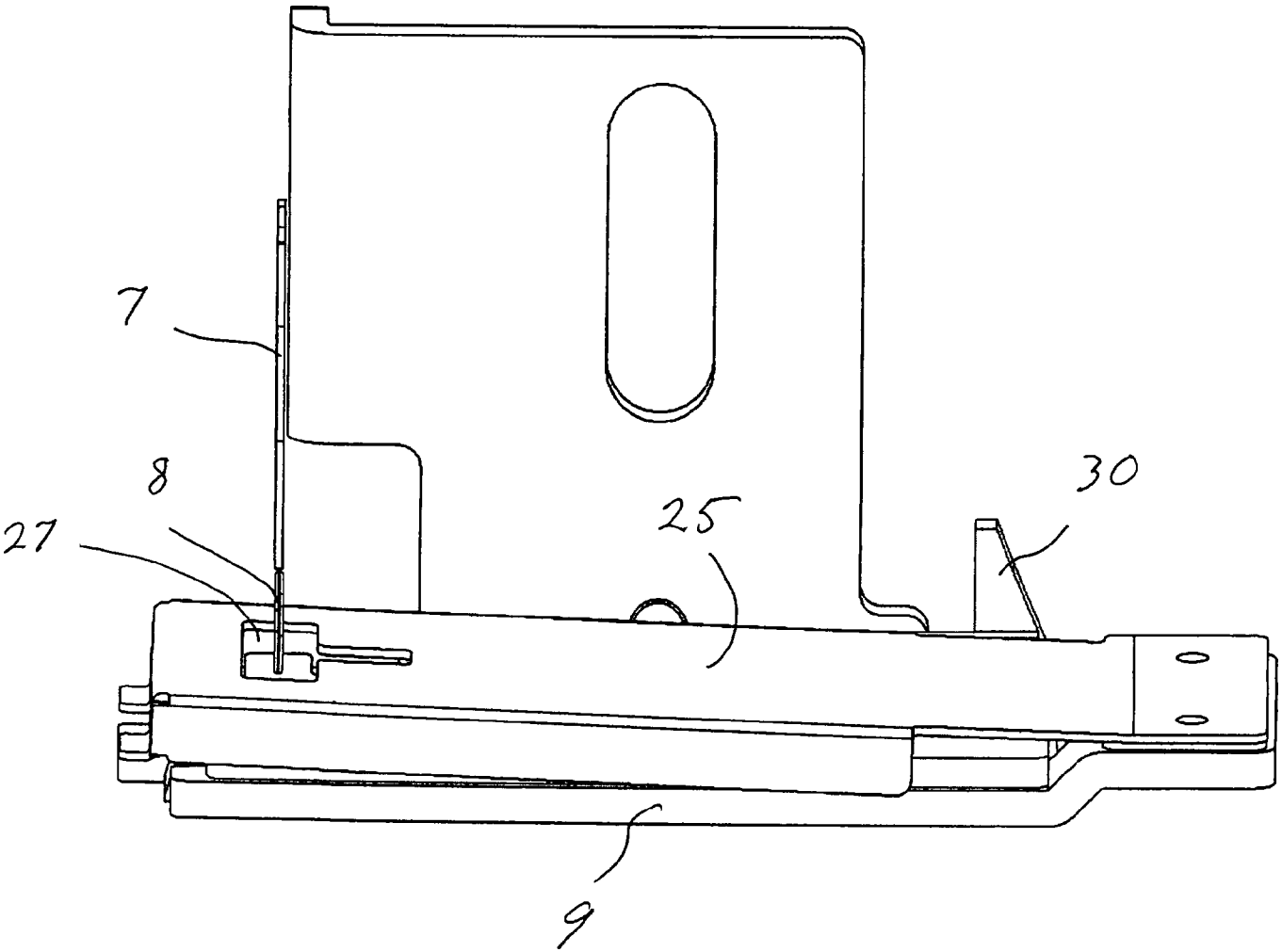
FIG. 7 is a view corresponding to FIG. 6 in which the stapling movement has been advanced a further phase.
Figure 9:
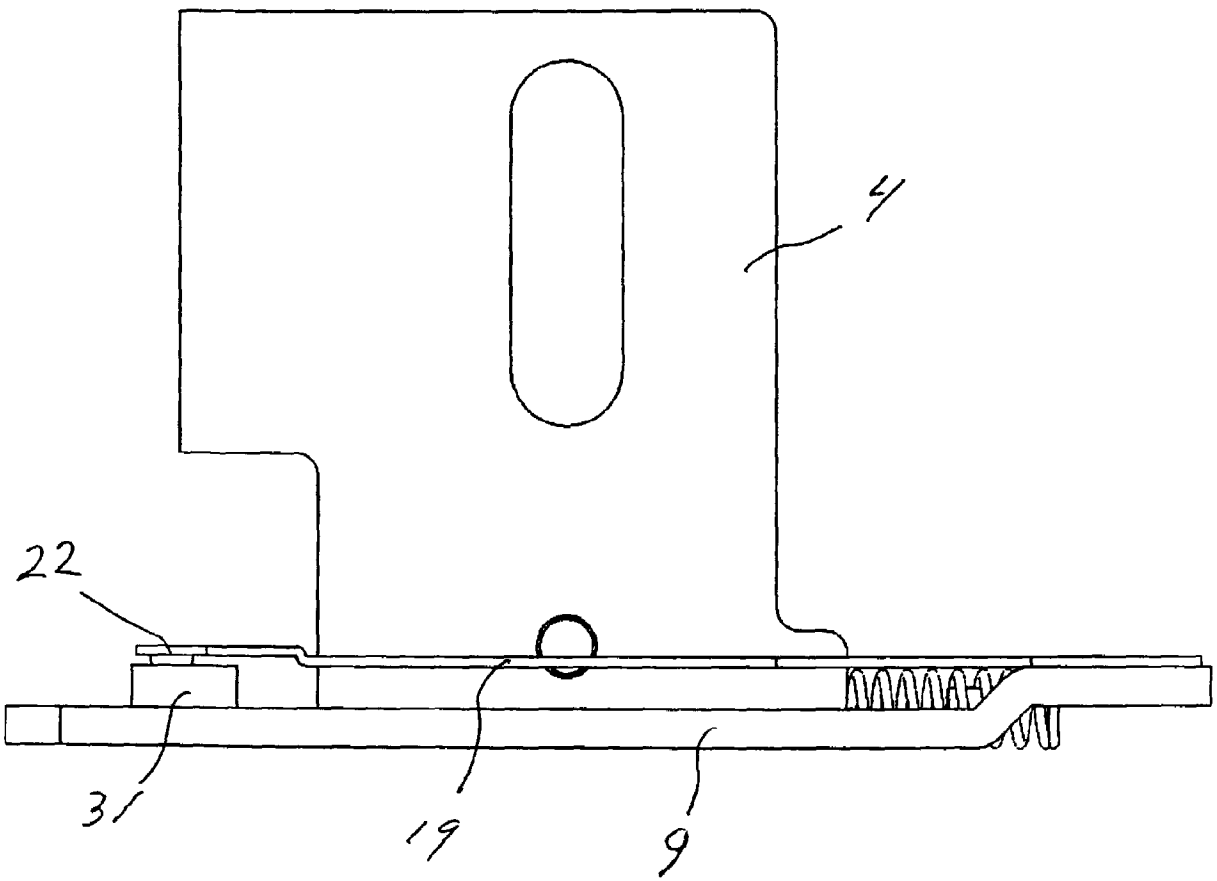
FIG. 9 is a side view showing in detail the anvil device included in the invention and a lower part included in the base part.

FIG. 9 shows that the front end of the lower part 9 is provided with a block 31 which extends upward into the recess 29 which, however, is not shown in FIG. 5.

Figure 10:
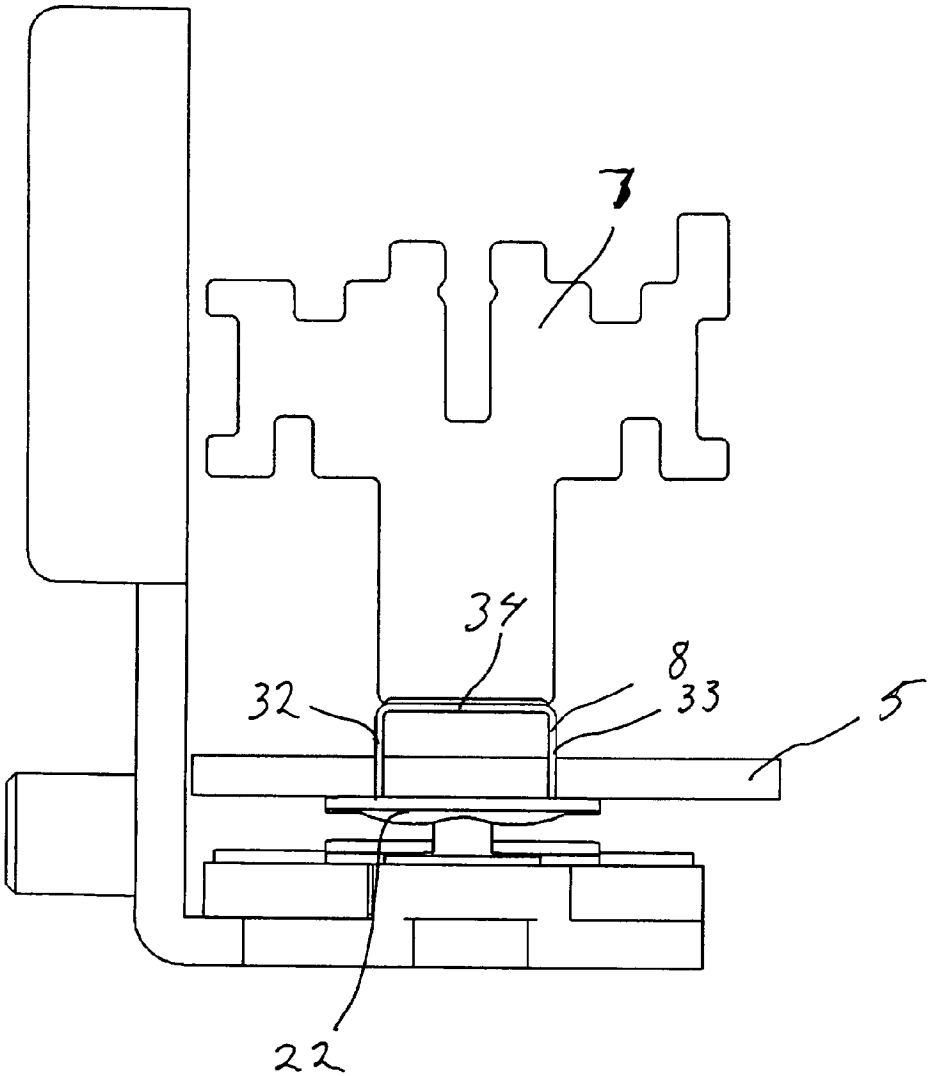
FIG. 10 is a schematic view showing the relationship between a staple driven into the workpiece and the anvil device at a point where the staple legs have penetrated the workpiece.
Figure 11:
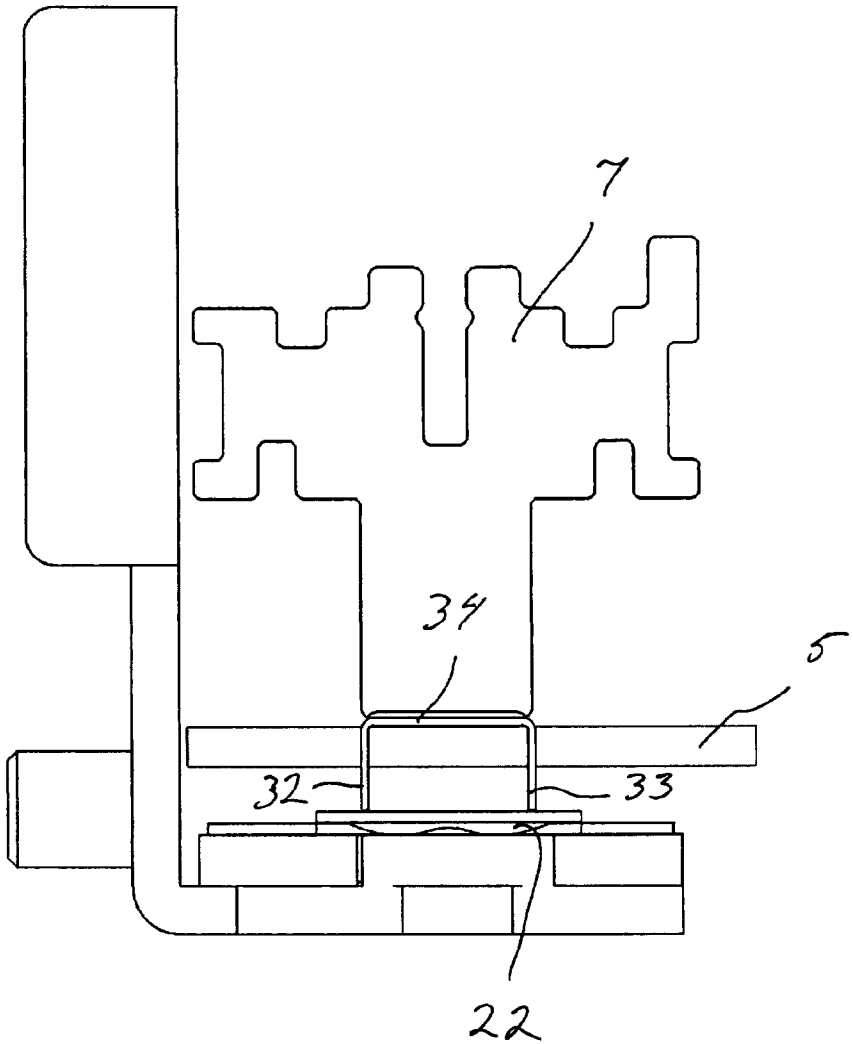
FIG. 11 is a view corresponding to FIG. 10 in which the staple crown has been driven into contact with the workpiece.
Figure 12:
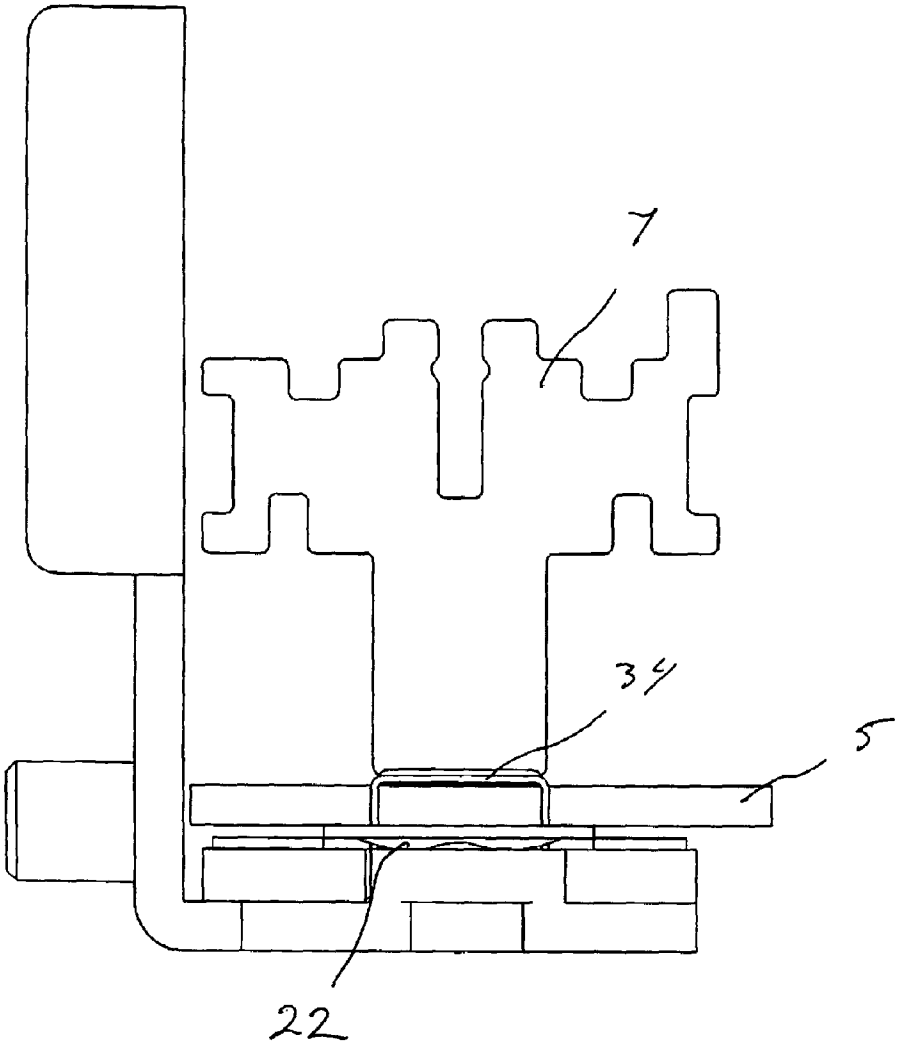
FIG. 12 is a view corresponding to FIGS. 10 and 11, showing the staple following the completion of stapling.

The function of the base part 2 during a stapling movement will hereinafter be described with reference to FIGS. 4 to 12. When a stapling movement is commenced, the anvil device is in the position shown in FIG. 4. In this position, the anvil device 22 blocks the staple opening 27, thereby preventing objects from falling through the opening 27 into the base part. In this position, the workpiece 5 to be stapled, which workpiece is shown only in FIGS. 10-12, is positioned over the opening 27. When stapling is commenced, a staple 8 is driven through the workpiece 5 by the driver 7 into the position shown in FIG. 10. The staple is then driven further through the workpiece into the position shown in FIG. 11, in which position the staple legs 32,33 have pushed the anvil device 22 downward into contact with the block 31 and into the recess 29, while the staple crown 34 is in contact with the workpiece 5. In this position, the hook element 30 is impelled by the stapling unit 3 to move in a direction opposite to direction V, thereby releasing the latch arrangement 15,28 between the upper part 25 and the lower part 9 and causing the upper part to be moved downward against the lower part, whereby the staple legs 32,33 are bent by the anvil device into contact with the underside of the workpiece 5 and the anvil device 22 assumes the same height as the contact surface 26 as shown in FIG. 8. The stapling unit 3 is then moved to the position shown in FIG. 1 and the upper part 25 is moved upward from the lower part 9 by the action of the spring 17, which presses the spacing device 12 in the direction V, whereby the surfaces 15 interact, in known manner, with the lugs 28 and lift the upper part from the lower part. The leaf spring 19 simultaneously moves the anvil device 22 back to the position shown in FIG. 4. If a workpiece 5 is not in place during the stapling movement, the staple 8 will be deposited on the anvil device and since this blocks the opening 27, there is no risk of the staple falling into the base part. In a subsequent stapling movement, the workpiece will displace the staple deposited on the anvil device and the staple, therefore, will not fall into the base part.

Although the figures show the anvil device connected to a leaf spring, it will easily be seen by one skilled in the art that the anvil device may be placed on a helical spring, which will thus press the anvil device against the opening, or that another type of spring element known to one skilled in the art may be used.

The invention is not limited by the above description, but is limited only by the accompanying claims.

The invention claimed is:

1. A stapler for stapling a workpiece, the stapler comprising:

a stapling unit and a base part which are connected so as to be movable toward and away from each other in a reciprocating stapling movement, wherein the stapling unit includes a driver and is adapted to contain staples, and the base part includes a lower part and an upper part having a contact surface with a staple opening therein, the workpiece to be placed against the contact surface during the stapling, wherein the upper part is connected to the lower part such that the upper part is movable, from an initial position, toward the lower part during the stapling movement, wherein a latching arrangement is provided between the lower part and the upper part to prevent the upper part from being moved toward the lower part, wherein an anvil device is arranged on the base part, wherein the stapling unit and the base part are arranged such that stapling is performed by moving the stapling unit relative to the base part and into contact with the workpiece, whereupon the driver drives a staple into the workpiece to a position in which a crown of the staple is in contact with the workpiece and legs of the staple extend through the staple opening, whereupon a releasing device arranged in the stapler releases the latching arrangement and the upper part and stapling unit are moved toward the lower part, whereby the staple legs are bent by the anvil device into contact with an underside of the workpiece, and wherein the anvil device is elastically supported on the base part by way of an elastic element in an area between the lower part and the upper part, the anvil device being urged by the elastic element toward the staple opening such that the anvil device blocks said staple opening when the upper part is in the initial position and such that the anvil device is displaced from the staple opening by the legs of the staple during at least a portion of the stapling movement.

2. A stapler according to claim 1, wherein the elastic element comprises a leaf spring, helical spring or other spring means.

3. A stapler according to claim 1, wherein during stapling, the staple legs displace the anvil device from the staple opening in a direction of stapling until the staple crown has been driven into contact with the workpiece.

4. A stapler according to claim 1, wherein the anvil device is in supporting contact with the lower part when the upper part is moved downward against the lower part.

5. A stapler according to claim 2, wherein during stapling, the staple legs displace the anvil device from the staple opening in a direction of stapling until the staple crown has been driven into contact with the workpiece.

6. A stapler according to claim 2, wherein the anvil device is in supporting contact with the lower part when the upper part is moved downward against the lower part.

7. A stapler according to claim 3, wherein the anvil device is in supporting contact with the lower part when the upper part is moved downward against the lower part.

8. A stapler according to claim 5, wherein the anvil device is in supporting contact with the lower part when the upper part is moved downward against the lower part.

9. A stapler for stapling a workpiece, the stapler comprising:

a base unit; and a stapling unit having a driver and adapted to contain staples, said stapling unit being movably connected to said base unit;

said base unit including:

a lower part, an upper part movably connected to said lower part and having a contact surface with a staple opening formed therein, the workpiece to be placed against said contact surface for stapling, the upper part being movable, from an initial position, toward the lower part during the stapling, and an anvil device configured to bend legs of a staple into contact with an underside of the workpiece, said anvil device being resiliently supported on a portion of said base unit so as to be urged to a position in which said anvil device blocks said staple opening in said upper part when the upper part is in the initial position and to be displaced from the staple opening by the legs of the staple during at least a portion of the stapling.

10. A stapler according to claim 9, comprising a latching arrangement to releasably latch said upper part and said lower part to one another.

11. A stapler according to claim 10, comprising a releasing device disposed to release said latching arrangement so as to allow said upper part to move toward said lower part.

12. A stapler according to claim 9, wherein said anvil device is resiliently supported by a spring.

13. A stapler according to claim 9, wherein the anvil device is resiliently supported such that, during stapling, legs of a staple displace said anvil device from said staple opening in a direction of stapling until a crown of the staple contacts an upper surface of the workpiece.

14. A stapler according to claim 9, wherein said anvil device is brought into supporting contact with said lower part when said upper part is moved toward said lower part.

15. A base unit for a stapler for stapling a workpiece, said base unit comprising:

a lower stapler base part, an upper stapler base part movably connected to said lower stapler base part and having a support surface for a workpiece to be stapled, with a staple opening being formed in said support surface, said upper stapler base part being movable, from an initial position, toward said lower stapler base part during stapling, and an anvil device configured to bend legs of a staple into contact with an underside of the workpiece, said anvil device being resiliently supported on a portion of said base unit so as to be urged to a position in which said anvil device blocks said staple opening in said upper stapler base part when said upper stapler base part is in the initial position and to be displaced from the staple opening by the legs of the staple during at least a portion of the stapling.

16. A base unit according to claim 15, comprising a latching arrangement to releasably latch said upper stapler base part and said lower stapler base part to one another.

17. A base unit according to claim 16, comprising a releasing device disposed to release said latching arrangement so as to allow said upper stapler base part to move toward said lower stapler base part.

18. A base unit according to claim 15, wherein said anvil device is resiliently supported by a spring.

19. A base unit according to claim 15, wherein said base unit is arranged such that said anvil device is displaced in a direction of stapling by legs of a staple until a crown of the staple contacts an upper surface of the workpiece.

20. A base unit according to claim 15, wherein said base unit is arranged such that said anvil device is brought into supporting contact with said lower stapler base part when said upper stapler base part is moved toward said lower stapler base part.

* * * * *